US006088455A

United States Patent [19]

Logan et al.

[11] Patent Number: 6,088,455

[45] **Date of Patent: *Jul. 11, 2000**

[54] METHODS AND APPARATUS FOR SELECTIVELY REPRODUCING SEGMENTS OF BROADCAST PROGRAMMING

[76] Inventors: James D. Logan, 81 Castle Hill Rd., Windham, N.H. 03087; Daniel F. Goessling, 43 Davelin Rd., Wayland, Mass. 01778; Richard S. Goldhor, 5 Falmouth St., Belmont, Mass. 02178

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,669

[22] Filed: Jan. 7, 1997

[51] Int. Cl.[7] ..... H04K 1/00

[52] U.S. Cl. ..... 380/200; 380/255; 340/825.3; 348/7

[58] Field of Search ..... 380/9, 200, 255; 348/7–13; 340/825.3

[56] References Cited

U.S. PATENT DOCUMENTS

| | | | |
|---|---|---|---|
| Re. 29,051 | 11/1976 | Jones . | |
| 3,810,156 | 5/1974 | Goldman . | |
| 4,023,456 | 5/1977 | Groeschel . | |
| 4,305,101 | 12/1981 | Yarbrough et al. | 360/69 |
| 4,305,131 | 12/1981 | Best | 354/514 |
| 4,811,325 | 3/1989 | Sharples, Jr. et al. | 369/85 |
| 4,918,730 | 4/1990 | Schulze | 381/43 |
| 4,931,950 | 6/1990 | Isle et al. | 364/514 |
| 5,063,610 | 11/1991 | Alwadish | 455/45 |
| 5,117,618 | 6/1992 | Dunlap et al. | 358/335 |
| 5,119,503 | 6/1992 | Mankovitz | 455/45 |
| 5,119,507 | 6/1992 | Mankovitz | 455/154.1 |
| 5,134,719 | 7/1992 | Mankovitz | 455/154.1 |
| 5,210,820 | 5/1993 | Kenyon | 395/2 |
| 5,276,909 | 1/1994 | Milner et al. | 455/38.5 |
| 5,307,456 | 4/1994 | Mackay | 395/154 |
| 5,319,455 | 6/1994 | Hoarty et al. | 348/571 |
| 5,371,551 | 12/1994 | Logan et al. | 348/571 |
| 5,406,558 | 4/1995 | Rovira et al. | 370/77 |
| 5,406,626 | 4/1995 | Ryan | 380/9 |
| 5,408,686 | 4/1995 | Mankovitz | 455/66 |
| 5,436,653 | 7/1995 | Ellis et al. | 348/2 |
| 5,485,518 | 1/1996 | Hunter et al. | 380/20 |
| 5,485,611 | 1/1996 | Astle | 395/600 |
| 5,524,051 | 6/1996 | Ryan | 380/9 |
| 5,526,284 | 6/1996 | Mankovitz | 364/514 |
| 5,541,638 | 7/1996 | Story | 348/7 |
| 5,548,828 | 8/1996 | Kozaki et al. | 455/161.2 |
| 5,557,541 | 9/1996 | Schulhof et al. | 364/514 |
| 5,561,849 | 10/1996 | Mankovitz | 370/110 |
| 5,572,194 | 11/1996 | Shiota | 340/825.25 |
| 5,572,442 | 11/1996 | Schulhof et al. | 364/514 |
| 5,574,999 | 11/1996 | Gzorren | 455/186.1 |
| 5,583,937 | 12/1996 | Ullrich et al. | 380/20 |
| 5,592,511 | 1/1997 | Schoen et al. | 375/220 |
| 5,671,195 | 9/1997 | Lee | 369/7 |
| 5,686,954 | 11/1997 | Yoshinobu et al. | 348/13 |

FOREIGN PATENT DOCUMENTS

| | | |
|---|---|---|
| 96/27840 | 9/1996 | WIPO . |
| 96/37965 | 11/1996 | WIPO . |

*Primary Examiner*—Pinchus M. Laufer
*Assistant Examiner*—Hrayr A. Sayadian

[57] ABSTRACT

Systems and methods for editing broadcast programming signals which allow a user to compile a proprietary signal tailored to the user's individual preferences are provided. Systems of the present invention include a receiver for receiving a broadcast programming signal in any broadcast format, a database memory having identification signals stored therein, a comparator for comparing portions of the broadcast signal with the identification signal in order to select those portions of the broadcast programming signal to be recorded, a data processor, and a compression buffer for storage of the selected broadcast programming signals. Methods of the present invention include receiving a broadcast programming signal, comparing the broadcast programming signal to an identification signal derived, employing a signal analyzer originally to derive the identification signals from the content of the broadcast programming before broadcast, so as to select a portion of the broadcast programming signal, and storing the selected portion in a memory.

9 Claims, 4 Drawing Sheets

METHODS AND APPARATUS FOR SELECTIVELY REPRODUCING SEGMENTS OF BROADCAST PROGRAMMING

FIELD OF THE INVENTION

The invention relates to systems and methods for processing broadcast programming signals, and more particularly, to systems and methods that allow for modifying radio broadcast signals to generate proprietary programming signals.

BACKGROUND OF THE INVENTION

Today, radio broadcast programming provides an important marketing tool for exposing the general public to commercially available musical recordings. To this end, each regional market typically contains a number of different radio stations, each of which provides programming for a select demographic segment of market. For example, each major regional market typically includes at least one radio station that broadcasts musical selections from Billboard Magazine's Top 40 Hits. Similarly, each regional market typically includes a classical music station that broadcasts musical selections from commercially available recordings of classical music.

Recording studios encourage and promote the broadcasting of musical selections from their studios by providing the radio stations with incentives, including free copies of recent recordings, sponsorships of contests, and local concerts, and other similar marketing techniques. Recording studios deem these promotions to be worthwhile in that marketing studies evidence that consumers purchase musical selections that are familiar to them. Accordingly, recording studios deem that the free distribution of their musical selections through radio broadcast programming facilitates the sales of their products by making the general population familiar with these products.

Although radio broadcasting offers an excellent technique for broadcasting high-quality musical selections, these radio stations are generally mass marketing tools and, therefore, provide programming tailored to universal tastes. However, the universal tastes of the general population generally dictate that radio broadcast programming is to include a varied selection of musical artists. Accordingly, recording studios rarely can convince radio stations to feature one of their artists by providing a sequence of selections from that particular artist. Moreover, radio stations typically emphasize only one or two selections from any one CD, and, therefore, offer a recording studio no outlet for exposing the public to less popular work of a particular artist.

Furthermore, recording studios that produce musical selections which stray from conventional tastes often find that regional markets lack any radio stations suited for carrying their musical selections and, therefore, lack a ready method for exposing the general public to their products.

Additionally, even if a radio station does offer a program suited to less universal tastes, typically that radio program is slotted for a less popular time slot than more universally accepted recordings. Consequently, even though the recording studio is provided with some exposure for its less popular works, the exposure is offered at a time slot that is less popular and, therefore, monitored by a smaller audience.

In response to this failure of existing radio stations to provide a distribution outlet for such recording studios, systems have been developed for distributing musical selections via computer networks, such as the Internet. Although these systems allow each recording studio to deliver inexpensively select copies of their products, the actual distribution is a cumbersome and slow process that requires each user to log onto a particular network site and maintain a connection during the download of the data. This can take as much as forty-five minutes for a high-fidelity audio download. Consequently, the general public disfavors these systems and they are infrequently used.

Accordingly, it is an object of the present invention to provide systems and methods that allow editing of a radio broadcast signal to generate a proprietary radio program.

It is a further object of the present invention to provide alternative methods for distributing audio information.

It is yet another object of the present invention to provide systems and methods for time shifting portions of a radio broadcast programming signal.

Other objects of the invention will be apparent to one of ordinary skill in the art, and others will be made apparent upon review of the following description and from review of the illustrated embodiments in conjunction therewith.

SUMMARY OF THE INVENTION

The invention will be understood in one aspect as systems for editing a radio broadcast programming signal so as to make it more suited to an individual audience member's tastes. In one embodiment, the systems according to the invention include a receiver for receiving a radio broadcast programming signal and which is capable of generating an output signal that can be sent to a data processing system. A data processing system can connect to a communications system that allows a user to download identification information that can be employed by the data processing system to identify certain portions of the radio broadcast programming signal. The data processing system can edit the radio broadcasting programming signal to generate a proprietary programming signal that includes only those musical selections preferred by the respective user.

More particularly, in one embodiment, the invention is understood as apparatus for monitoring a broadcast programming signal. The apparatus can include a receiver having an output for providing a data signal representative of the broadcast programming signal, a data processor, in electrical communication with the output of the receiver, and having a program for directing the data processor to process the data signal to identify a segment of the data signal being representative of a first category of data. The first category of data can be data representative of music, alternatively, of speech or of some other type of information that can be processed with the invention without departing from the scope thereof. Systems of the invention can further include a compression buffer that has an interface coupled to the data processor for transmitting and receiving the data signal, a compression processor for compressing and decompressing the data signal, and a memory for storing the data signal in a compressed format. The system can also have a monitor that couples to the compression buffer for generating as a function of the data signal, an audio signal. These systems can optionally include a delimiter for editing the data signal to include a mark signal which is representative of a starting point of the segment.

In a further embodiment, the apparatus can include a local database memory that has storage for an identification signal being representative of an identifying characteristic of a known segment of the broadcast signal. The segments of a broadcast signal can be understood as a set of discrete portions that make up the signal, such as the songs played during a radio show, the opening theme song of a show, a commercial, or any other of the component programming materials that make up a radio broadcast. These identification signals can be maintained in a local database memory, a remote database accessed by a communication system for connecting to the remote database, or a combination of both.

Additionally, these systems can include a comparator for comparing portions of the segment signal with the identification signals to identify within the segment a known portion of the broadcast programming signal. In this embodiment, the apparatus can include a memory that has storage for an introduction signal associated with the identification signal and being representative of an initial portion of a known segment of the broadcast programming signal. The comparator can compare the introduction signal to the segment to generate a deviation signal which represents the differences between the broadcast programming signal and the introduction signal. In this way, the apparatus of the invention can determine if the initial portion of the segment of the broadcast signal varies from the initial portion of the original version of a known segment. This allows the apparatus to determine if the initial portion of the segment has been "talked over" by an announcer. Optionally, in response to a deviation signal that indicates that the initial portion of a selection has been "talked over", the system can choose to modulate the amplitude of the respective data signal to provide a fade-in effect that allows the detected musical selection to start from a reduced volume and grow louder during the "talked-over" portion to a volume selected by the user.

Accordingly, in one embodiment the invention can include systems that access a remote database, such as a web site or an FTP site, and collect a set of identification signals. The system can then employ the identification signals to hunt through a broadcast program and identify any of these known segments. In an optional embodiment, the apparatus can include an agent for selecting one of the identification signals responsive to a preference characteristic. As such, a user can provide the agent with a set of preferences and the agent can select identification signals dictated by these preferences. This provides a system that edits broadcast signals to correspond to the preferences of an individual audience member.

In a further embodiment of the invention, the system can include a signal processor for analyzing the data signal to identify a characteristic representative of information of a first category. In this embodiment, the signal processor can include a scene change detector for identifying a discontinuity in the signal content of the data signal. The signal processor can include a voice recognition processor for detecting an occurrence of a speech signal within the data signal. The signal processor can allow the detection of transition points between different segments of the broadcast signal.

The systems of the invention can also include a transition detector for identifying a transition marker within the data signal. A data processor can include a digital encoder that has a sample rate controller for generating at a selected sample rate a signal representative of the broadcast programming signal. Moreover, the apparatus can include a playback control for controlling the rate of providing the data signal to the compression processor. In this embodiment, the compression processor can include a feedback generator for generating a feedback signal representative of an audio indication of a rate of providing the data signal to the compression processor.

Optionally, the systems of the invention can include a search element for searching the data signals as a function of the mark signal to move between segments of the data signal. These systems can also include a monitor that has a fade control, responsive to a deviation signal, for controlling a volume of an audio signal. Further the systems can have a timer controller for generating the audio signal at a select time.

Systems according to the invention can be used for storing and playing captured segment signals. The systems can include a playback controller for providing the storage segment signals to the monitor in a select order. The segment memory can include an attribute memory for storing an attribute signal representative of a characteristic of a respective one of the segments. The playback controller can include an element for providing segments to the monitor as a function of the attribute signal, and the attribute signal can be generated by an attribute generator which can generate the attribute signal to be representative of a characteristic of the segment including its length, date of recording, associated performing artist, or any other characteristic.

The systems of the invention can also include a segment memory that has an encryption element for storing the segment in an encrypted format, and can further include a shredding mechanism for shredding the segment in response to providing the respective segment to the monitor.

Moreover, the invention can include a clipping element that is responsive to the mark signals for generating a copy of the segment. A notation element can provide a notation signal for that particular copy, and the copy and the notation signal can be delivered, such as by e-mail, to another user or location.

BRIEF DESCRIPTION OF THE ILLUSTRATED EMBODIMENTS

DESCRIPTION OF THE ILLUSTRATED EMBODIMENTS

Figure 1:
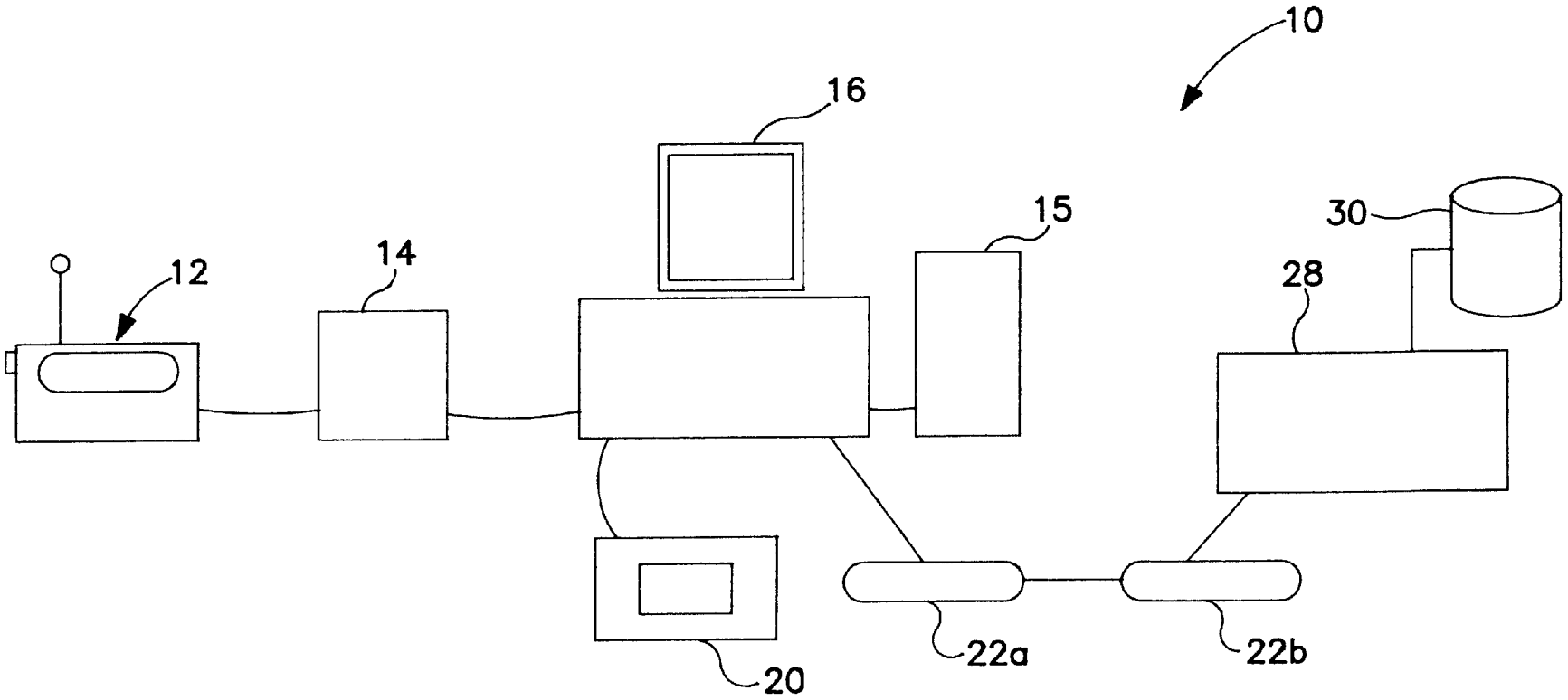
FIG. 1 depicts a functional block diagram of one system for modifying broadcast signals according to the invention.

FIG. 1 depicts a system 10 that includes a receiver 12, a digital processor 14, a data processor 16, a speaker 18, a recording element 20, a communications system 22, a remote data processor 28 and a remote database 30.

As depicted by FIG. 1, the receiver 12 couples via a transmission path to the digital processor 14 which couples via a transmission path to the data processor 16. The data processor 16 couples to the cassette recorder 20, the speaker 15 and the communications system 22. The communication system 22 includes a first element coupled to the processor 16 via a transmission path and a second element 22B and that couples to the communications system 22A via a communications path illustrated in FIG. 1 as a dotted line. The communications system 22B couples to the remote processor 28 to deliver signals therebetween and the remote processor 28 couples via a transmission path to the remote database 30.

In the illustrated embodiment, the receiver 12 is depicted as a FM radio receiver that includes an antenna for receiving broadcast programming signals transmitted as radio frequency (RF) signals. The depicted receiver 12 includes a tuner element for selecting a particular channel for receiving radio programming broadcasts transmitted on that channel. The receiver 12 includes an output and provides a data signal to the digital processor 14. The receiver 12 can provide an output data signal in an analog format that can be received by the digital processor 14 and digitally sampled by the processor 14. The digitally encoded signal can be provided via the illustrated transmission path to the data processing system 16.

The receiver 12, which is depicted as an RF tuner, can be any receiver element suitable for receiving broadcast programming signals and that includes an output for providing a data signal representative of the broadcast programming signal for processing by the systems 10. Any suitable transmission path can be employed for communicating data between the elements of the systems, including optical fiber, radio frequency link, electrical bus, or any other path suitable for transmitting data. Further, multiple tuners can be connected to the system to allow for simultaneous scanning of multiple broadcast channels. Optionally the receiver 12 can comprise a data communication interface for receiving signals via the Internet and representative of streamed audio information. The communication interface will include a software audio processor, such as Progressive Networks, Real Audio codec software that converts a bit stream into an audio signal. Optionally, song identification can be performed in part by decoding identification data transferred with the streamed audio. The identification can be employed to turn the depicted recording system 20, on and off.

In one embodiment of the system 10, the receiver 12 is a conventional stereo tuner and couples to a digital processor 14 that comprises a sound card, such as the SoundBlaster card manufactured by the Creative Labs Company, which is coupled into the backplane of the data processor 16. Alternatively, the receiver 12 can be a computer peripheral that is mountable within the backplane of the data processor 16 and that includes a receiver element for demodulating RF frequency broadcast transmissions and that includes a digital processor, such as the digital processor 14, for generating digital signals representative of the demodulated transmissions.

The digital processor 14 optionally includes a sample rate controller that allows for the selective control of the digital sample rate employed for digitizing the data signal provided by the receiver 12. Optionally, the sample rate controller operates under the instruction of the data processing system 16 to provide a digitized data signal having a select sample rate. This provides, inter alia, control over the file size of the digitized data signal. By selectively controlling the sample rate of the output signal, the digital processor 14 allows the data processor 16 to reduce file size with an associated loss of fidelity. Conversely, increasing the sample rate of the output signal will produce larger file sizes and provide digital data signals having higher fidelity.

The data processor 16 depicted in FIG. 1 can be a conventional digital data processing system, such as an IBM PC-compatible system. Such systems can include a central processing unit, a programming memory and a data storage memory. In the embodiment depicted in FIG. 1, the data processor 16 includes a computer program that executes on the data processor 16 to configure the data processor 16 as a device according to the invention for modifying a broadcast programming signal to generate a proprietary program signal that can be more suited to the individual users tastes and preferences. In one embodiment, the program directs the data processor to employ a comparator that can identify known segments of the broadcast programming signal. The comparator can be a electrical circuit card assembly, a software program, or a combination of both. As will be explained in greater detail hereinafter, the comparator can employ known signal processing techniques that identify a signal by comparing the signal, to a library of known signals or signal characteristics.

To this end, the data processor 16 can optionally include a compression buffer that has an interface to receive the data signal provided by the digital processor 14. The interface can be hardware or software depending upon the integration of the digital processor 14 with the data processor 16, and allows for the exchange of data. The compression buffer can further include a compression processor that compresses and decompresses the data signal into a signal format that has reduced size and therefore facilitates the storing of large volumes of data. The compression buffer further will include an interface to a memory for storing the data signal in the compressed format. One compression buffer suitable for use in the present invention is described in U.S. Pat. No. 5,371,551 issued to Logan et al., the teachings of which are incorporated herein by reference.

In an alternative embodiment, the data processor 16 can include a compression buffer implemented by a software module operating on the data processor 16 to receive the data signal from the digital processor 14 and to store the data signal in a compressed format within a memory element of the data processor 16. The data processor 16 can include a memory element for storing the compressed data signal, and the memory element can be a persistent memory element such as a hard disk or tape drive, or a volatile memory element such as an electronic memory. The electronic memory can comprise a RAM memory element and can further include a cache RAM memory having storage for a portion of the data signal.

The data processor 16 can connect to a monitor element that couples to the compression buffer and generates, as a function of the data signal, an audio signal. The monitor can be any audio generator suitable for processing the data signal to generate an audio signal of the type suitable for playing over a speaker, such as the depicted speaker element 15. In one embodiment of the invention, the monitor element can be a sound card that couples into the backplane of the data processing system 16 and that couples to a speaker such as the depicted speaker 15. The speaker 15 can be any speaker including any of the commercially available speaker systems marketed for use with multi-media computer applications.

The data processor 16 can optionally include a timer that provides a computer readable time signal representative of the time of day. The program operating on the data processor 16 can employ the timer to provide the data signal to the monitor at a selected time, to therefore play the proprietary programming signal at a user-selected time. The timer can be a computer peripheral clock element including any of the conventional computer clock elements commonly used with data processing systems such as the data processor 16.

The depicted cassette recorder 20 can be a conventional recorder element suitable for connecting to an audio signal generator, such as a conventional sound card computer peripheral. The recorder 20 depicted in FIG. 1 is shown as a cassette recorder element that records an audio signal onto a cassette tape to provide a persistent record copy of the audio signal. The recording process can be directed by the program operating on the data processor, and allows a user to create audio tapes of selected songs. Although the depicted embodiment includes a cassette recorder, it will apparent to one of ordinary skill in the art that this optional element can be any recording element suitable for providing a persistent record copy of the audio signal.

The depicted communication systems 22A and 22B are devices that allow for the transmission of computer readable data signals between a local and remote computer system. In one embodiment both communication systems 22A and 22B are telecommunications systems, such as modems, suitable for transmitting data signals across the public switching telephone network (PSTN).

The communication system 22B couples to a remote data processor 28. The remote data processor 28 can be a digital data processor system of the type suitable for running a Web server process that provides a remote node, such as the data processor 16, with graphical access to computer readable data, such as data that is accessed over the Internet via Universal Resource Locators (URLs). As further depicted in FIG. 1, the remote data processor 28 can couple via a transmission path to the remote database element 30. The remote database element 30 can be a computer memory system that provides persistent memory storage for computer readable information. In one embodiment, the computer memory 30 provides storage for identification signals wherein each identification signal can be representative of an identifying characteristic of a known portion of a broadcast signal. For example, the identification signal can be a set of features that have been extracted from a musical selection, such as a song, and which act as an identifying characteristic of that particular song. Accordingly, the data processor 28 in operation with the memory 30 can provide a web site that a user of the data processor 16 employs to couple to URLs or other data sites that provide identification signals for identifying portions of the broadcast signal captured by the receiver element 12. The identification signals can be directly downloaded, or can be selected for delivery by an alternate method, such as mail delivery of a CD-ROM or disk having the signals stored thereon.

In operation, a user at the data processing system 16 can log on to a Web service running on the digital processor 28 and from the Web service identify hypertext links to URLs of identification signals for songs of interest to that particular user. The user can download the identification signals to a local database and employ the local database to search the broadcast programming signal to identify songs of interest to that user. Alternatively, the data processor 16 can employ agent software modules that search through sources of computer readable information to identify identification signals that are of interest to the user. These agent modules can be of the type developed by the Firefly Corporation of Cambridge, Mass. However, any agents suitable for searching sources of computer readable information and for selecting portions of that computer readable information can be practiced with the invention without departing from the scope thereof.

Figure 2:
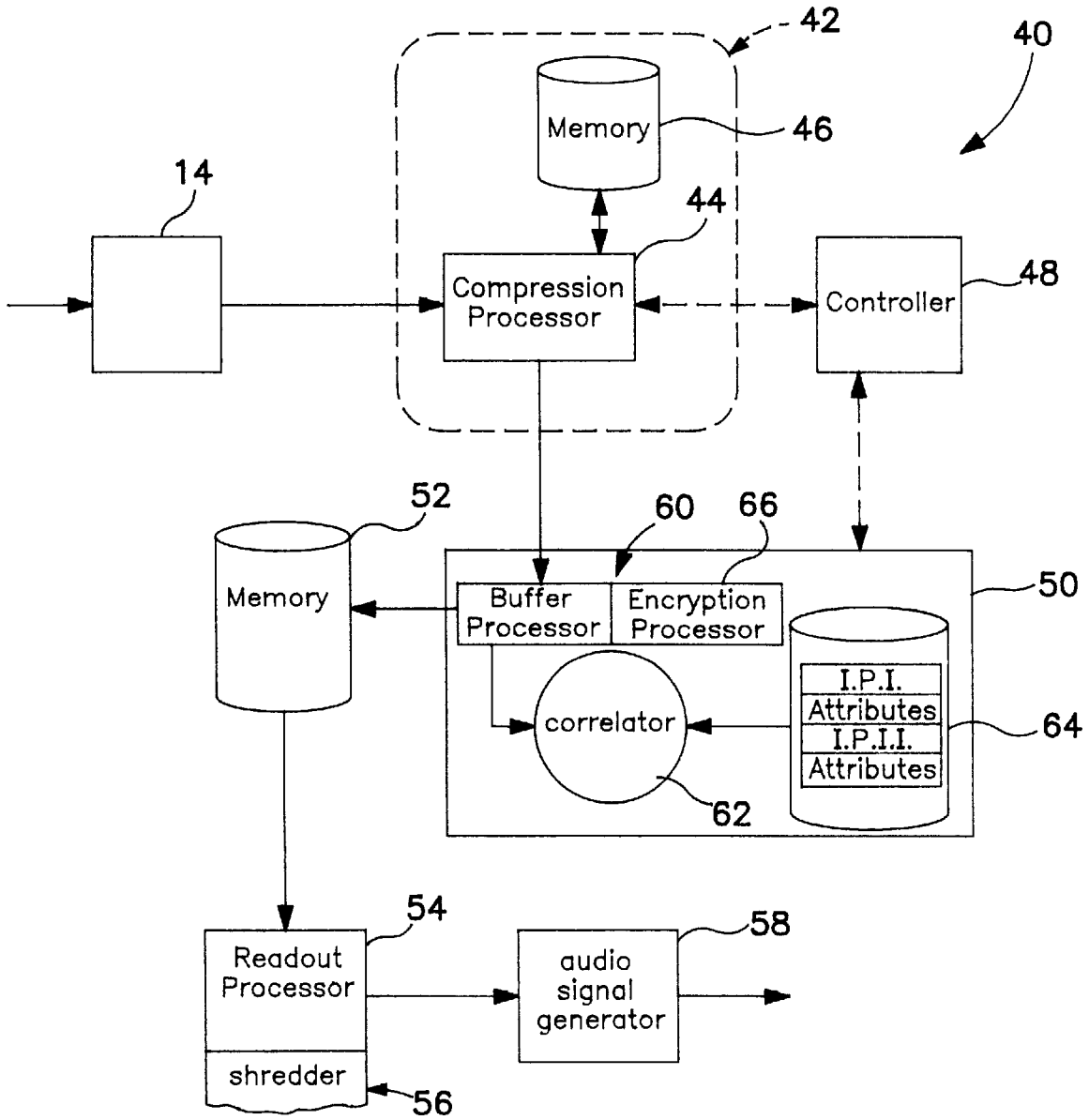
FIG. 2 depicts one embodiment of a system for identifying segments of a broadcast signal suitable for use with the system depicted in FIG. 1.

FIG. 2 depicts in more detail, an embodiment of the invention that employs the identification signals, such as the type which can be downloaded from a remote Web site, to identify segments of the data signal provided by the receiver 12. As depicted in FIG. 2, the system 40 includes a compression buffer 42 having a compression processor 44 and a compression memory 46, a controller 48, a comparator 50, a segment memory 52, a read-out processor 54, an audio signal generator 58, a buffer processor 60, a correlator 62, and an identification signal memory 64.

As for the embodiment depicted in FIG. 2, the digital processor 14 coupled to the compression buffer 42 provides a digitized data signal to the compression processor 44. The compression processor 44 can compress the digitized data signal into a format that requires reduced storage space to store the compressed digital data signal within the compression memory 46. Again, the compression buffer 42 depicted in FIG. 2 can be a compression processor of the type described in U.S. Pat. No. 5,371,551 issued to Logan et al. Alternatively, the compression buffer can be a software module executing on a digital data processing system to store the digital data signal in a compressed format within the persistent or volatile memory of the data processing system.

As further depicted in FIG. 2, the compression buffer 42 couples via a transmission path to the comparator element 50. The compression buffer 42 passes, via the transmission path, a decompressed version of the digital data signal to the buffer processor 60 of the comparator 50. The buffer processor 60 can be an electrical circuit card assembly that includes a data processor and a computer memory. The computer memory can have a data memory for buffer storing the data signal, and a program memory for storing a series of instructions for directing the operation of the buffer processor 60. In operation, the buffer processor 60 can store a portion of the data signal within the computer memory. The correlator element 62 can couple between the buffer processor 60 and the identification signal memory 64. The identification signal memory 64 can store identification signals, each of which is representative of a portion of a known segment of the broadcast programming signal. In one practice, a segment of the broadcast programming signal can be a single song selection. Alternatively, a segment can be an opening theme song to a radio program, an advertisement, or any other portion of a radio broadcast that can represent a discrete segment of that radio program.

The identification signal memory 64 can store for any one of the segments, an identification signal that has information suitable for identifying the occurrence of that known segment within the data signal provided by the receiver element 12. Accordingly, the comparator 50 searches the data signal representative of the broadcast programming signal for the occurrence of one or more of those known segments by identifying an identification signal stored within the identification signal memory 64 and representative of the known segment.

As depicted in FIG. 2, the correlator element 62 connects between the buffer processor 60 and the identification signal memory 64. The controller 48 will direct the compression buffer 42 to download a portion of the data signal stored in a compressed format within the memory 46 to the buffer processor 60. The correlator 62 can then process the portion of the data signal within the buffer. Processor 60 can correlate that downloaded portion with one or more of the identification signals stored within the identification signal memory 64. If the correlator 62 determines no match to exist between that portion of the data signal and any one of the identification signals within the memory 64, the comparator 50, via the depicted bi-directional transmission path, informs the controller 48 and the controller 48 directs the compression buffer 42 to download another segment of the data signal.

The comparator 50 depicted in FIG. 2 can employ any correlation device or technique for processing an identification signal to detect the occurrence of a known segment of a data signal. In one embodiment, the comparator 50 includes a correlator 62 of the type disclosed in U.S. Pat. No. 4,843,562 issued to Kenyon et al., the teachings of which are incorporated herein by reference. The comparator 50 can be an electrical circuit card assembly or a software module executing on the data processor 16. In the embodiment depicted in FIG. 2, the comparator 50 includes an identification signal memory 64 that has identification signals and attribute signals associated with the program segment identified by the respective identification signal.

In one embodiment, the attribute signal is representative of the length of the segment being identified. More particularly, the attribute signal provides a preceding signal length and a succeeding signal length, each of which respectively describes the period of time that the known segment runs respective to the portion of the segment that is associated with the identification signal. Consequently, the correlator 62, upon detecting a match between the data signal in the buffer processor 60 and one of the identification signals, can delimit a beginning and end for the segment associated with the respective identification signal. For example, an identification signal within memory 64 can include an attribute signal that identifies the length of time that the program segment runs before the occurrence of the identifying portion and similarly the length of time that the program segment continues for after the occurrence of the identifying portion. The buffer processor 60 can include a computer program that can employ these attribute signals to generate a mark signal that delimits the beginning and end of the program segment to mark one segment of the broadcast programming signal.

In a further embodiment, these systems can include a memory that has storage for an introduction signal associated with the identification signal that is representative of an initial segment of the known segment of the broadcast programming signal. The comparator can compare the introduction signal to the segment to generate a deviation signal which represents the differences between the broadcast programming signal and the introduction signal. In this way, the apparatus of the invention can determine if the initial portion of the segment of the broadcast signal varies from the initial portion of the original version of a known segment. This allows the apparatus to determine if the initial portion of the segment has been "talked over" by an announcer. Optionally, in response to a deviation signal that indicates the initial portion of a selection has been "talked over", the system can include a fade control to modulate the amplitude of the respective data signal to provide a fade-in effect that allows the detected musical selection to start from a reduced volume and grown louder during the "talked over" portion to a volume selected by the user.

Upon marking a known segment, the buffer processor 60 can store the segment within the segment memory 52 to provide a database of selected segments. In the depicted embodiment, the buffer processor 60 includes an encryption processor 66 that operates as an encryption mechanism that encrypts the segments for storing in an encrypted format. The encryption processor can implement a private key encryption process that employs a key stored in the buffer processor and maintained in secret from the user. The encryption processor 66, therefore, provides segments in an encrypted format for being stored in memory 52. This provides a database of segment signals that cannot be copied by the user to make unauthorized reproductions of stored segment signals. In the depicted embodiment, the encryption processor 66 is illustrated as part of the buffer processor 60. However, the encryption processor 66 can be disposed at other locations, including at the memory 52, the output of the digital processor 14 with a decryption processor positioned before the correlator 62, and at any other suitable location. Any encryption processor that can encrypt the data signals can be employed by the invention.

The segment memory 52 can be any memory device suitable for storing data signals representative of computer readable information, including a disk drive, a tape drive, or any other memory device. The segments can be stored as a data file or in any other suitable format. The memory 52 can couple to the read-out processor 54 that can read out the data from memory 52 and provide the data to the audio signal generator 58 that provides a signal suitable for playing over a speaker, such as the speaker 18 depicted in FIG. 1.

The buffer processor 60 can also include a program that operates as an attribute generator for generating attribute signals in a format suitable for storing with the segments. The generator can provide title attributes, data attributes, album attributes, and other characteristic information. The attribute information can be stored in the memory 52 or in a separate attribute memory. The playback controller can employ the attribute information to retrieve segments in a select order, for example, by artist data, style, album order, or any other such order that can be provided by attribute signals.

The read-out processor 54 can optionally include a playback control for controlling the rate at which the data signal is played as an audio signal. Signal processing techniques for compressing the playing time of an audio signal are commonly employed by broadcast stations, and others, and are techniques well known in the art of signal processing. Any of these techniques can be employed by the read-out processor, the audio signal generator 58, or a separate playback controller element.

The playback control allows a user at the data processing system 16 to control the rate at which segments are played back through the speaker 18. The playback control can also include a pitch control mechanism, including any of the known pitch control systems suitable for controlling the pitch of the audio signal. Further, the playback controller can include a search mechanism that detects marker signals between segments for searching between the stored segments. The marker signals can include title and other information and can be inserted by a computer program executing on the buffer processor 60 as segments are stored in the memory 52. This allows a user at station 16 (the user's data processor) to fast forward through the different segments stored in memory 54.

In conjunction with the playback control, the read-out processor 54 can include a feedback generator that mixes with the segment a feedback signal that provides an audio indication of the rate at which the data signal is being provided to the audio generator 58. The feedback generator can alternatively intermix feedback data with the data signal being provided to the audio generator. This will provide an audio feedback signal that will provide an indication as to the rate at which segments are being played out of the memory 52. In one practice, the feedback generator generates a squeal signal that provides an audio signal reminiscent of the sound provided by a cassette tape when the tape is being fast forwarded through a cassette recorder and gives an audio indication of the rate of fast forward.

Alternatively, the feedback generator can process the data signal to provide a playback signal that sounds like the audio signal being played at a higher than normal speed. This also provides an audio indication of the playback rate, and allows a user to listen for marker signals, and thereby check if the markers have been properly inserted at the beginning and ends of the signal. The program will allow manual editing to correct misplaced markers.

Figure 3:
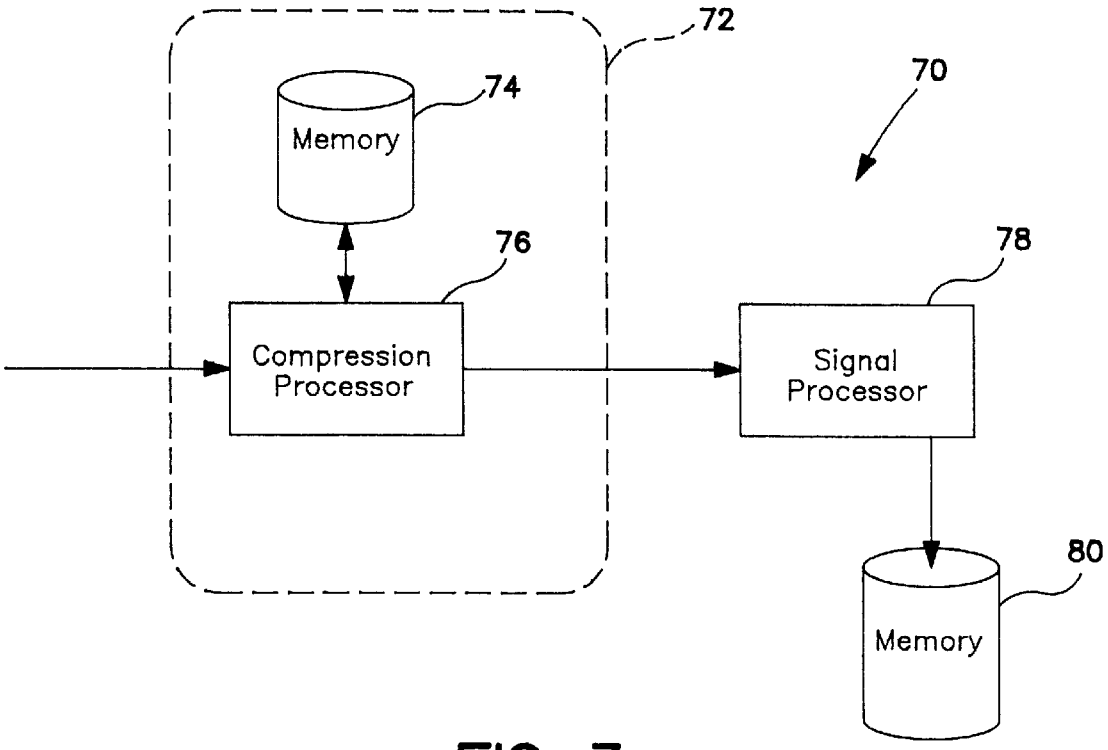
FIG. 3 depicts an alternative embodiment of a system for identifying segments and being practicable with the system depicted in FIG. 1.

The editing program also allows a user to clip a segment and direct that segment to be stored by the recording element 20 depicted in FIG. 3. Additionally, the editing program can receive input from a notation element, like a keyboard, or microphone, to add user generated data to the clipped segment. The annotated segment can be recorded, or clipped and transferred by email, or other data transfer system to a remote site.

The depicted readout processor can be a circuit card assembly or a software module. The depicted readout processor 54 includes a shredder mechanism 56 that can decrypt an encrypted segment signal, to provide to the audio generator 58 a signal suitable for processing into an audio signal. Further, the shredder mechanism can delete any decrypted segment signal after it is transmitted to the audio signal generator 58, and can shred any copies of encrypted or decrypted segment signals by encrypting such signals with a randomly generated key, typically provided by a random number generator in the processor that is deleted after encryption of the segment signals. This allows the shredder 56 to delete any copies of the segment and to prevent the making of additional copies.

FIG. 3 depicts an alternative embodiment of the invention that employs a signal processor to identify segments of a data signal provided by the receiver 12. As depicted in FIG. 2, there is a system 70 that includes a compression buffer 72 having a memory 74, and a compression processor 76. As further shown, the system 70 includes a signal processor 78 that can couple to the compression buffer 72 and that can further couple to a memory 80.

The depicted compression buffer 72 can be, as described above, a compression buffer that receives a data signal from the receiver 12 and that provides storage, in a compressed format, for that data signal. Also as described above, this compression buffer 72 can follow from the teachings of U.S. Pat. No. 5,371,557 issued to Logan et al. The depicted signal processor 78 can be an electronic circuit card assembly that couples into the backplane of the data processor 16 depicted in FIG. 1. The signal processor 78 processes a signal provided by the compression buffer 72 to identify segments of that data signal that are of interest to a system user. In one embodiment, the signal processor 78 employs a scene-change analysis process for determining transition markers that occur within the data signal and that are representative of transitions between segments of the program. One scene change analysis process detects known marks inserted within the broadcast programming signal. For example, scene change processes exist that detect a black screen signal within a TV signal, wherein the black screen signals identify segments like commercials, local programming signals, and other segments. Similarly, a radio broadcast programming signal can include scene changes identified by a marker such as a tone or other encoded signal, even a jingle. The scene change process detects the marker to identify transitions between segments of the broadcast signal. However, any discontinuity can be detected for determining changes between scenes.

Alternatively, signal processor 78 can include a voice recognition process that distinguishes music from speech. The signal processor 78 employs this process to detect transitions between segments of the data signal which are representative of speech signals, and which are typically associated with advertisements, news, and other program segments that a user may wish to filter from the programming signal.

In this embodiment, the signal processor 78 identifies those portions of the data signal that are representative of speech signals and deletes these segments from the data signal. The signal processor 78 then stores the modified data signal within the memory 80. Further, the signal processor 78 could process the signal to detect other attributes of the programming signal, including attributes related to user preferences, such as voice recognition to detect selected speakers or artists, songs with lyrics, songs without lyrics, certain instruments, and other such attributes. In this embodiment, segments having select attributes can be saved from the broadcast and stored. Accordingly, the data processor 16 shown in FIG. 1 can apply the modified data signal stored in memory 80 to the monitor and thereby provide an audio signal that contains a reduced content of advertising, news, voice over, and other interruptions to the broadcast music program.

Figure 4:
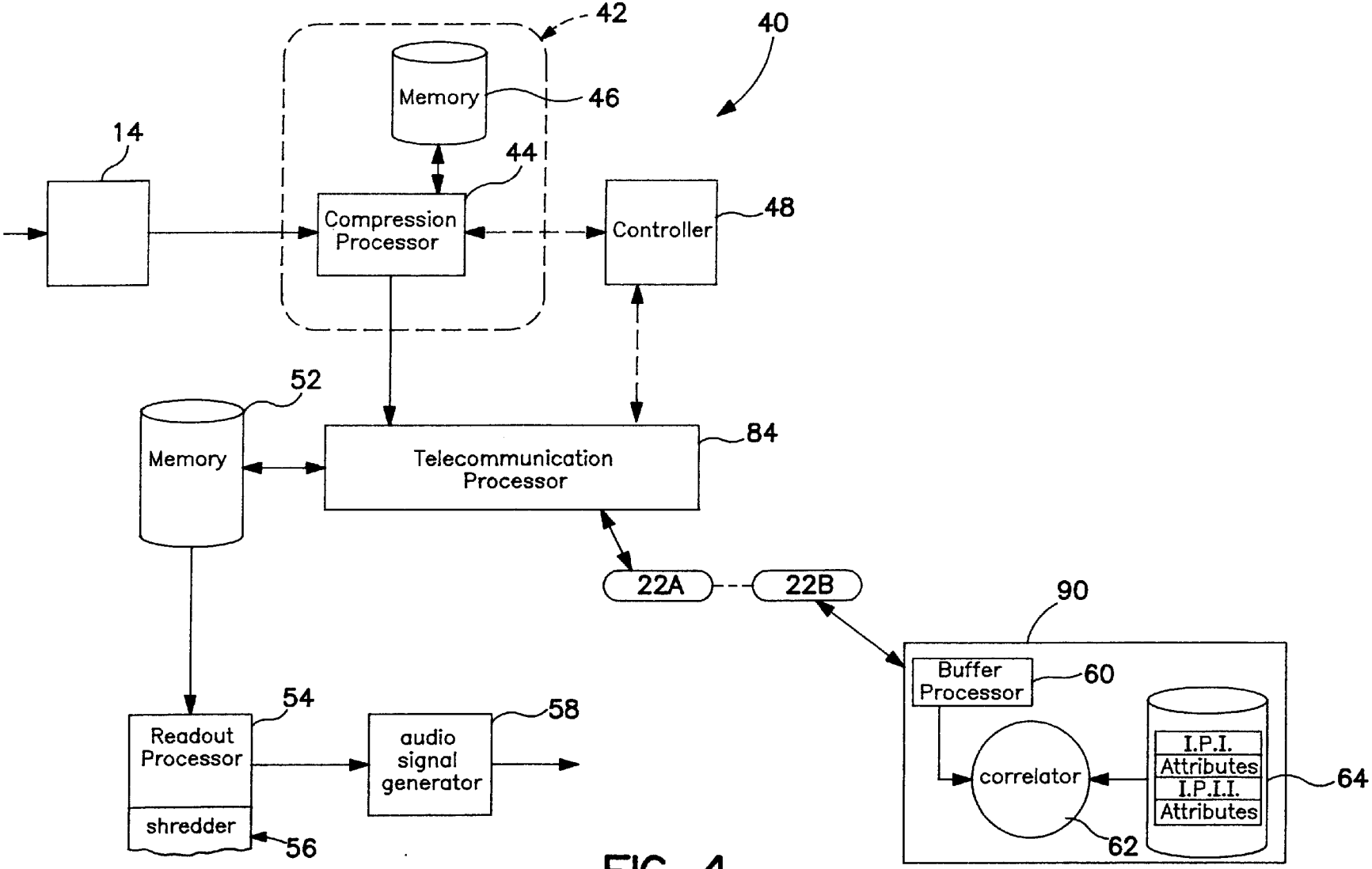
FIG. 4 depicts an embodiment of the invention that includes a remote system for identifying segments of a broadcast signal.

FIG. 4 depicts a further alternative embodiment of the invention and includes a telecommunication processor 84 that couples via the communication processors 22A and 22B to a remote data processor 90, such as a web site, that includes a comparator configured as the comparator 50 shown in FIG. 2. In particular, the comparator includes the buffer processor 60, a correlator 62, and an identification signal memory 64.

In this embodiment, the data processor 16 can extract the information from the broadcast signal and operate the telecommunication processor 84 to send the information via the datalink 22A and 22B to the remote computer system 90. The remote computer system 90 can then process the signals, according to any of these techniques described above, and send back identification information to the local data processor 16. In this way, the signal processing operations employed for identifying known segments of a broadcast programming signal can be run on a remote computer system, and the local database of identification signals depicted in FIG. 2, can be replaced by a shared resource memory.

Accordingly, one advantage of the system depicted in FIG. 4 is that the remote processor can be controlled, updated, and modified by a system administrator. This can allow the system administrator to update readily the recognition algorithms employed by the processor 90 as well as to provide computer hardware more suitable than the conventional data processing systems, to provide rapid recognition of known segments of a broadcast programming signal.

The depicted telecommunications processor 84 can be an electronic circuit card assembly or a software module running on the data processor 16 and interfaces to the compression processor 44, the controller 48, the memory 52, and the communications system 22A. The telecommunications processor 84 bundles portions of the data signal provided by the compression processor 44 for transmission via the communications modules 22A and 22B to the remote processor 90. As described above, the comparator within the processor 90 can determine if the data signal transmitted by the telecommunication processor 84 contains a known segment. If no known segment is identified, the processor 90 through the communication modules 22A and 22B can notify the telecommunication processor 84 which, via a bi-directional bus, directs the controller 48 to operate the compression processor 44 to download another portion of the data signal. This operation continues, as discussed above, until the entire data signal has been processed and those portions of the signal which have been recognized by the processor 90 have had via identification information transmitted from processor 90 via communication modules 22A and 22B to the telecommunication processor 84 for storage within the memory 52.

In a further embodiment of the invention, the systems include a signal-to-noise processor that improves the audio fidelity of segments collected by a particular user. In this embodiment, the signal-to-noise processor records a particular program segment several times and combines the recordings. The effect of this is to increase the signal-to-noise ratio, for example by approximately 3 dB, for two recordings, 6 dB, for four recordings, and so forth. This multiple recording technique takes advantage of one characteristic of noise, namely that it is a stochastic component of a signal. Accordingly, as noise is a zero-mean Gaussian signal and each recording is made with a radio signal of approximately equal strength, or can be so adjusted by the signal processor, the combination of multiple recordings provides for improved signal-to-noise characteristics for the identified segment.

In this embodiment, the signal-to-noise processor can further include a time alignment processor that corrects for the tempo changes applied to a particular program segment, i.e. broadcasting radio station. For example, a broadcasting radio station may, for the purposes of complying with predefined program schedules, speed up or slow down a musical recording to have the program segment fall within the predefined schedule. The tempo processor provides for correlation of the two signals. The correlation of the signals can be performed as described above, or by employment of any of the known techniques for correlating a plurality of signals. By correlation of the plural recorded program segments, the signal-to-noise processor can combine the plural signals to generate a single program segment recording having improved audio fidelity.

In an optional embodiment of the invention, the systems include a playback controller, as described above, that further includes a system for providing identification information for selected segments of the broadcast programming signal. For example, the system could identify attributes for particular segments, such as the title of the segment, the artist performing the segment, one or more albums that have a recording of this segment, and other such information.

In one embodiment, the system can employ the identification signals stored in the identification memory 64. Each identification signal can include a set of attributes which provides information useful to the user to identify the program segment associated with the respective identification signal. Upon identification of a program segment, the system can provide, for example, by displaying on a video screen of data processor 16, the user with attribute information that identifies the program segment.

In an alternative embodiment of the invention, the system can access a remote site having access to a large database of identification signals and associated attributes. At this remote site, a portion of the broadcast sent by the system can be compared to the identification signals that are stored within the database to identify a known segment of the broadcast. Upon identification of one or more program segments, the attribute signals associated with these program segments can be transferred to the user's system to provide the user with information that is descriptive of the identity of the respective program segments.

Accordingly, in these embodiments of the invention, the system provides for a user to identify the name of a song being played on a radio by comparing a portion of a broadcast programming signal being monitored with a series of identification signals stored in a database, remote or local, which provides information about the title, or other attributes, of the song being identified. In alternative practices of the invention, these systems for identifying attributes of a particular program segment can employ other techniques for capturing characteristics of the program segment which can be compared against characteristics of known segments stored in a database.

For example, a profile of a characteristic of a segment can be generated by examining the short-term energy of a particular segment, or portion of a segment. This profile can be compared against a database of known profiles for certain segments to identify one or more segments that have similar profiles. Other information, such as the radio station broadcast channel, time of day, user preferences and so forth, can be employed for narrowing the list of identified segments to identify, more particularly, one or more profiles of segments that are likely to be the segment being monitored by the user. The identified segment or segments can be provided to the user, thereby identifying the segment being monitored.

It will thus be seen that the invention efficiently attains the objects set forth above, among those made apparent from the preceding description. Since certain changes may be made in the systems and methods described above including rearranging the arrangement and groupings of the above-described elements, substituting hardware for software, and other such modifications, without departing from the scope of the invention, it is intended that all matters containing the above description or shown in the accompanying drawings be interpreted as illustrative and not in a limiting sense.

It is also to be understood that the following claims are intended to cover all generic and specific features of the invention herein described, and all statements of the scope of the invention which, as a matter of language, might be said to fall therebetween.

What is claimed is:

1. The method of selectively reproducing segments of broadcast programming which comprises, in combination, the steps of:

employing a signal analyzer to derive a plurality of identification signals from the content of said broadcast programming, each of said identification signals uniquely specifying an identifying characteristic of the content of a corresponding segment of said broadcast programming, storing said plurality of identification signals in a database, receiving an incoming broadcasted signal from one or more sources, comparing the content of the programming in said incoming broadcasted signal with said identification signals in said database to detect of the presence of at least one of said identifying characteristics in said broadcasted signal persistently storing a copy of that particular segment of said incoming broadcasted signal that includes the detected one of said identifying characteristics, and thereafter reproducing said particular segment in response to a request from a user.

2. The method as set forth in claim 1 wherein each of said identification signals stored in said database further specifies the time position of said identifying characteristic relative to said beginning and ending of said corresponding segment.

3. The method as set forth in claim 2 wherein said step of reproducing said particular segment in response to a request from a user comprises, in combination, the substeps of establishing a predetermined playback order in which persistently stored segments are reproduced, reproducing a first of said segments, accepting a request from said user to play the next segment, and discontinuing the reproduction of said first of said segments and resuming reproduction at the beginning of the next segment in said predetermined playback order.

4. The method as set forth in claim 1 wherein said step of deriving a plurality of identification signals from the content of said broadcast programming is performed at a server location remote from a client location at which said steps of receiving, comparing and reproducing are performed.

5. The method as set forth in claim 4 further including the step of transferring said plurality of identification signals from said server location to said client location via a communications network.

6. The method as set forth in claim 4 further including the step of performing an Internet Web server process at said server location to accept from said client location a specification of desired programming segments and the step of downloading identification signals corresponding to said desired programming segments from said server location to said database at said client location.

7. Apparatus for reproducing selected segments of broadcast programming which comprises, in combination, a source of a plurality of segments of broadcast programming, a signal analyzer coupled to said source for deriving from each given one of said segments an identification signal which specifies an identifying characteristic unique to said given one of said segments and which further includes timing data which specifies the time position of said characteristic relative to the beginning and ending of said given one of said segments, means coupled to said processing means for storing said identification signal in a database of segment identification signals, a receiver for acquiring an incoming broadcast programming signal, a comparator for matching said incoming broadcast programming signal with said database of identification signals to identify the presence of a component of said broadcast programming signal which corresponds to a characteristic specified by a particular one of the segment identification signals in said database, segment storage means responsive to said comparator for storing a portion of said broadcast programming signal defined by the time position of said component and said timing data from said particular one of said segment identification signals.

8. Apparatus as set forth in claim 7 wherein said signal analyzer is located a site remote from the location of said receiver.

9. Apparatus as set forth in claim 7 further including playback means coupled to said segment storage means for selectively reproducing programming stored in said segment storage means.

* * * * *